US007911414B1

(12) United States Patent
Wedding et al.

(10) Patent No.: US 7,911,414 B1
(45) Date of Patent: Mar. 22, 2011

(54) METHOD FOR ADDRESSING A PLASMA DISPLAY PANEL

(75) Inventors: Carol Ann Wedding, Toledo, OH (US); Jeffrey W. Guy, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 792 days.

(21) Appl. No.: 11/782,122

(22) Filed: Jul. 24, 2007

Related U.S. Application Data

(63) Continuation-in-part of application No. 10/840,262, filed on May 7, 2004, now Pat. No. 7,307,602, which is a continuation-in-part of application No. 10/036,074, filed on Jan. 4, 2002, now abandoned, which is a continuation of application No. 09/759,280, filed on Jan. 16, 2001, now abandoned.

(60) Provisional application No. 60/176,756, filed on Jan. 19, 2000.

(51) Int. Cl.
*G09G 3/28* (2006.01)

(52) U.S. Cl. ..... 345/60; 315/169.4

(58) Field of Classification Search ..... 345/60–69, 345/690–692, 214; 313/296–301; 315/169.1–169.4
See application file for complete search history.

(56) References Cited

U.S. PATENT DOCUMENTS

| | | | |
|---|---|---|---|
| 3,499,167 | A | 3/1970 | Baker et al. |
| 3,559,190 | A | 1/1971 | Bitzer et al. |
| 3,603,836 | A | 9/1971 | Grier |
| 3,801,861 | A | 4/1974 | Petty et al. |
| 3,803,449 | A | 4/1974 | Schmersal |
| 4,063,131 | A | 12/1977 | Miller |
| 4,087,805 | A | 5/1978 | Miller |
| 4,087,807 | A | 5/1978 | Miavecz |
| 4,126,807 | A | 11/1978 | Wedding et al. |
| 4,126,809 | A | 11/1978 | Wedding et al. |
| 4,233,623 | A | 11/1980 | Pavliscak |
| 4,320,418 | A | 3/1982 | Pavliscak |
| 4,494,038 | A | 1/1985 | Wedding et al. |
| 4,611,203 | A | 9/1986 | Criscimagna et al. |
| 4,683,470 | A | 7/1987 | Criscimagna et al. |
| 5,410,219 | A | 4/1995 | Takei et al. |
| 5,436,634 | A | 7/1995 | Kanazawa |

(Continued)

FOREIGN PATENT DOCUMENTS

EP 1 020 838 A1 7/2000

(Continued)

OTHER PUBLICATIONS

J. Ryeom et al., "High-Luminance and High-Contrast HDTV PDP with Overlapping Driving Scheme", pp. 743-746, *Proceedings of the Sixth International Display Workshops*, IDW 99, Dec. 1-3, 1999, Sendai, Japan.

(Continued)

*Primary Examiner* — Abbas I Abdulselam
(74) *Attorney, Agent, or Firm* — Donald K. Wedding

(57) ABSTRACT

The priming or conditioning of an AC gas discharge plasma display panel for improved selective write and selective erase which comprises addressing n number of rows in an order or sequence that is changed from frame to frame such that later rows to be addressed are advanced in the sequence with each subsequent frame. Each frame consists of the addressing of all n rows. Specific embodiments include the use of plasma-shells, plasma-tubes, and/or combinations thereof.

16 Claims, 9 Drawing Sheets

U.S. PATENT DOCUMENTS

| | | | | |
|---|---|---|---|---|
| 5,446,344 | A | 8/1995 | Kanazawa | |
| 5,541,618 | A | 7/1996 | Shinoda | |
| 5,661,500 | A | 8/1997 | Shinoda et al. | |
| 5,674,553 | A | 10/1997 | Shinoda et al. | |
| 5,724,054 | A | 3/1998 | Shinoda | |
| 5,736,815 | A | 4/1998 | Amemiya | |
| 5,745,086 | A | 4/1998 | Weber | |
| 5,793,158 | A | 8/1998 | Wedding, Sr. | |
| 5,828,356 | A | 10/1998 | Stoller | |
| 5,903,245 | A | 5/1999 | Shimizu et al. | |
| 5,914,563 | A | 6/1999 | Lee et al. | |
| 6,034,657 | A | 3/2000 | Tokunaga et al. | |
| 6,052,101 | A | 4/2000 | Moon | |
| 6,088,009 | A | 7/2000 | Moon | |
| 6,097,358 | A | 8/2000 | Hirakawa et al. | |
| 6,198,476 | B1 | 3/2001 | Hong et al. | |
| 6,208,081 | B1 | 3/2001 | Eo et al. | |
| 6,252,574 | B1 | 6/2001 | Hosoi et al. | |
| 6,262,699 | B1 | 7/2001 | Suzuki et al. | |
| 6,288,693 | B1 | 9/2001 | Song et al. | |
| 6,340,960 | B1 | 1/2002 | Song et al. | |
| 6,344,841 | B1 | 2/2002 | Moon | |
| 6,362,800 | B1 | 3/2002 | Moon | |
| 6,384,802 | B1 | 5/2002 | Moon | |
| 6,433,763 | B1 | 8/2002 | Lim et al. | |
| 6,466,187 | B1 | 10/2002 | Moon | |
| 6,492,776 | B2 | 12/2002 | Rutherford | |
| 6,496,164 | B1 | 12/2002 | Kuwahara et al. | |
| 6,559,814 | B1 | 5/2003 | Kanazawa et al. | |
| 6,636,187 | B2 * | 10/2003 | Tajima et al. | 345/55 |
| 6,864,631 | B1 | 3/2005 | Wedding | |
| 6,985,125 | B2 | 1/2006 | Velayudhan et al. | |
| 7,122,961 | B1 | 10/2006 | Wedding | |
| 7,157,854 | B1 | 1/2007 | Wedding | |
| 7,167,146 | B2 | 1/2007 | Kang | |
| 7,176,628 | B1 | 2/2007 | Wedding | |
| 7,247,989 | B1 | 7/2007 | Wedding | |
| 7,307,602 | B1 * | 12/2007 | Wedding et al. | 345/61 |
| 7,375,342 | B1 | 5/2008 | Wedding | |
| 7,405,516 | B1 | 7/2008 | Wedding | |
| 7,456,571 | B1 | 11/2008 | Wedding | |
| 7,456,808 | B1 | 11/2008 | Wedding | |
| 2002/0135548 | A1 | 9/2002 | Moon | |
| 2002/0175906 | A1 | 11/2002 | Moon | |

FOREIGN PATENT DOCUMENTS

| | | |
|---|---|---|
| WO | WO 00/30065 | 5/2000 |

OTHER PUBLICATIONS

Kanazawa et al., *1999Digest of the Society for Information Display*, pp. 154-157.

Tokunaga et al., "Development of New Driving Method for AC-PDPs", *Pioneer Proceedings of the Sixth International Display Workshops*, IDW 99, pp. 787-790, Dec. 1-3, 1999, Sendai, Japan.

* cited by examiner

| | Scan Sequence | | | | | | |
|---|---|---|---|---|---|---|---|
| Frame 1 | 18A-1 | 18A-2 | 18A-3 | *** | 18A-n-2 | 18A-n-1 | 18A-n |
| Frame 2 | 18A-2 | 18A-3 | *** | 18A-n-2 | 18A-n-1 | 18A-n | 18A-1 |
| Frame 3 | 18A-3 | *** | 18A-n-2 | 18A-n-1 | 18A-n | 18A-1 | 18A-2 |
| *** | | | | | | | |
| Frame n-2 | 18A-n-2 | 18A-n-1 | 18A-n | 18A-1 | 18A-2 | 18A-3 | *** |
| Frame n-1 | 18A-n-1 | 18A-n | 18A-1 | 18A-2 | 18A-3 | *** | 18A-n-2 |
| Frame n | 18A-n | 18A-1 | 18A-2 | 18A-3 | *** | 18A-n-2 | 18A-n-1 |

METHOD FOR ADDRESSING A PLASMA DISPLAY PANEL

RELATED APPLICATIONS

This is a continuation in part under 35 U.S.C. 120 of U.S. patent application Ser. No. 10/840,262, filed May 7, 2004 now U.S. Pat. No. 7,307,602 which is a continuation in part under 35 U.S.C. 120 of U.S. patent application Ser. No. 10/036,074, filed Jan. 4, 2002 now abandoned which is a continuation under 35 U.S.C. 120 of U.S. patent application Ser. No. 09/759,280, filed Jan. 16, 2001, now abandoned with a claim of priority under 35 U.S.C. 119(e) of Provisional Application 60/176,756, filed Jan. 19, 2000.

FIELD OF INVENTION

This invention relates to an AC gas discharge plasma display panel (PDP) device wherein an ionizable gas is confined within an enclosure and is subjected to sufficient voltage(s) to cause the gas to discharge. This invention particularly relates to the priming or conditioning of the ionizable gas in an AC gas discharge (plasma) display device. Examples of gas discharge (PDP) devices contemplated in the practice of this invention include both monochrome (single color) AC plasma displays and multicolor (two or more colors) AC plasma displays. This invention may be used to prime a PDP made of plasma-shells, plasma-tubes, or a combination of plasma-shells and plasma-tubes.

BACKGROUND

PDP Structures and Operation

A gas discharge plasma display panel (PDP) comprises a multiplicity of single addressable picture elements, each element referred to as a pixel, cell, or pel. As used herein, pixel or cell includes pel which is sometimes used in the prior art. The electrodes are generally grouped in a matrix configuration to allow for selective addressing of each pixel or cell. In a multicolor PDP, two or more pixels or cells may be addressed as sub-pixels or sub-cells to form a single pixel or cell. As used herein, pixel or cell means sub-pixel or sub-cell. The pixel or cell element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a pixel site are insulated from the gas with a dielectric. In a DC gas discharge one or more of the electrodes is in contact with the gas.

Several types of voltage pulses may be applied across a plasma display cell gap to form a display image. These pulses include a write pulse, a sustain pulse, and an erase pulse. The write pulse is of a sufficient voltage potential to ionize the gas at the pixel site and is selectively applied across selected pixel sites. The ionized gas will produce visible light and/or invisible light such as UV, which excites a phosphor to glow. In an AC gas discharge, sustain pulses are a series of pulses that produce a voltage potential across pixels to maintain ionization of pixels previously ionized. An erase pulse is used to selectively extinguish ionized pixels.

The voltage at which a pixel will ionize, sustain, and erase depends on a number of factors including the distance between the electrodes, the composition of the ionizing gas, and the pressure of the ionizing gas. Also of importance is the dielectric composition and thickness. To maintain uniform electrical characteristics throughout the display, it is desired that the various physical parameters adhere to required tolerances. Maintaining the required tolerance depends on display structure, cell geometry, fabrication methods and the materials used. The prior art discloses a variety of plasma display structures, cell geometries, methods of construction, and materials.

AC PDP

AC gas discharge devices include both monochrome (single color) AC plasma displays and multicolor (two or more colors) AC plasma displays. Examples of monochrome AC gas discharge (plasma) displays are well known in the prior art and include those disclosed in U.S. Pat. Nos. 3,559,190 (Bitzer et al.), 3,499,167 (Baker et al.), 3,860,846 (Mayer), 3,964,050 (Mayer), 4,080,597 (Mayer), 3,646,384 (Lay), and 4,126,807 (Wedding), all incorporated herein by reference.

Examples of multicolor AC plasma displays are well known in the prior art and include those disclosed in U.S. Pat. Nos. 4,233,623 (Pavliscak), 4,320,418 (Pavliscak), 4,827,186 (Knauer et al.), 5,661,500 (Shinoda et al.), 5,674,553 (Shinoda et al.), 5,107,182 (Sano et al.), 5,182,489 (Sano), 5,075,597 (Salavin et al.), 5,742,122 (Amemiya et al.), 5,640,068 (Amemiya et al.), 5,736,815 (Amemiya), 5,541,479 (Nagakubi), 5,745,086 (Weber), and 5,793,158 (Wedding), all incorporated herein by reference.

This invention described herein refers to an AC plasma display. The PDP industry has used two different AC plasma display panel (PDP) structures, the two-electrode AC columnar discharge structure and the three-electrode AC surface discharge structure. Columnar discharge is also called co-planar discharge.

Columnar AC PDP

The two-electrode columnar or co-planar discharge plasma display structure is disclosed in U.S. Pat. Nos. 3,499,167 (Baker et al.) and 3,559,190 (Bitzer et al.) The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multicolor columnar discharge PDP structure as disclosed in U.S. Pat. No. 5,793,158 (Wedding), phosphor stripes or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding ('158), each light-emitting pixel is defined by a gas discharge between a bottom or rear electrode x and a top or front opposite electrode y, each cross-over of the two opposing arrays of bottom electrodes x and top electrodes y defining a pixel or cell.

Surface Discharge AC PDP

The three-electrode multicolor surface discharge AC plasma display panel structure is widely disclosed in the prior art including U.S. Pat. Nos. 5,661,500 (Shinoda et al.), 5,674,553 (Shinoda et al.), 5,745,086 (Weber), and 5,736,815 (Amemiya), all incorporated herein by reference.

In a surface discharge PDP, each light-emitting pixel or cell is defined by the gas discharge between two electrodes on the top substrate. In a multicolor RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also referred to as a row sustain electrode because it functions to address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and secluded from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode.

DC PDP

This invention may be practiced in a DC gas discharge (plasma) display which is well known in the prior art, for example as disclosed in U.S. Pat. Nos. 3,788,722 (Milgram), 3,886,390 (Maloney et al.), 3,886,404 (Kurahashi et al.), 4,035,689 (Ogle et al.), 4,297,613 (Aboelfotoh), 4,329,626 (Hillenbrand et al.), 4,340,840 (Aboelfotoh et al.), 4,532,505 (Holz et al.), 5,233,272 (Whang et al.), 6,069,450 (Sakai et al.), 6,160,348 (Choi), and 6,428,377 (Choi), all incorporated herein by reference.

Single Substrate PDP

There may be used an AC or DC PDP structure having a so-called single substrate or monolithic plasma display panel structure having one substrate with or without a top or front viewing envelope or dome. Single substrate or monolithic plasma display panel structures are well known in the prior art and are disclosed by U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all incorporated herein by reference.

AC/DC PDP

This invention may be used with a hybrid PDP which uses both AC gas discharge and DC gas discharge. Examples of AC/DC PDP structures and methods of operating are disclosed in U.S. Pat. Nos. 4,613,854 (Holz et al.), 4,595,919 (Holz et al.), 4,575,716 (Holz et al.), 4,533,913 (Tezucar et al.), 4,518,894 (Andreadakis), 4,386,348 (Holz et al.), 4,373,157 (Holz et al.), 4,329,616 (Holz et al.), and 4,315,259 (McKee et al.), all incorporated herein by reference.

PDP with Microspheres, Beads, Ampoules, Capsules

The construction of a PDP out of gas filled hollow microspheres is known in the prior art. Such microspheres are referred to as spheres, beads, ampoules, capsules, bubbles, shells, and so forth. The following prior art relates to the use of microspheres in a PDP and are incorporated herein by reference. U.S. Pat. No. 2,644,113 (Etzkorn) discloses ampoules or hollow glass beads containing luminescent gases that emit a colored light. In one embodiment, the ampoules are used to radiate ultraviolet light onto a phosphor external to the ampoule itself. U.S. Pat. No. 3,848,248 (MacIntyre) discloses the embedding of gas filled beads in a transparent dielectric. The beads are filled with a gas using a capillary. The external shell of the beads may contain phosphor. U.S. Pat. No. 3,998,618 (Kreick et al.) discloses the manufacture of gas filled beads by the cutting of tubing. The gas is a rare gas mixture, 95% neon and 5% argon at a pressure of 300 Torr. U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber discloses the removal of these residual gases by heating the glass shells at an elevated temperature to drive out the gases through the heated walls of the glass shell. Roeber obtains different colors from the glass shells by filling each shell with a gas mixture, which emits a color upon discharge, and/or by using a glass shell made from colored glass. U.S. Pat. No. 4,963,792 (Parker) discloses a gas discharge chamber including a transparent dome portion. U.S. Pat. No. 5,326,298 (Hotomi) discloses a light emitter for giving plasma light emission. The light emitter comprises a resin including fine bubbles in which a gas is trapped. The gas is selected from rare gases, hydrocarbons, and nitrogen. Japanese Patent 11238469A, published Aug. 31, 1999, by Tsuruoka Yoshiaki of Dainippon discloses a plasma display panel containing a gas capsule. The gas capsule is provided with a rupturable part, which ruptures when it absorbs a laser beam. Also incorporated herein by reference is U.S. Pat. No. 6,864,631 (Wedding), which discloses a PDP comprised of microspheres filled with ionizable gas.

PDP Tubes

U.S. Pat. Nos. 7,176,628, 7,157,854, and 7,122,961 issued to Carol Ann Wedding disclose PDP structures with elongated display tubes (called plasma-tubes) and are incorporated herein by reference.

The following prior art references also relate to the use of elongated tubes in a PDP and are incorporated herein by reference. U.S. Pat. No. 3,602,754 (Pfaender et al.) discloses a multiple discharge gas display panel in which filamentary or capillary size glass tubes are assembled to form a gas discharge panel. U.S. Pat. Nos. 3,654,680 (Bode et al.), 3,927,342 (Bode et al.), and 4,038,577 (Bode et al.) disclose a gas discharge display in which filamentary or capillary size gas tubes are assembled to form a gas discharge panel. U.S. Pat. No. 3,969,718 (Strom) discloses a plasma display system utilizing tubes arranged in a side-by-side, parallel fashion. U.S. Pat. No. 3,990,068 (Mayer et al.) discloses a capillary tube plasma display with a plurality of capillary tubes arranged parallel in a close pattern. U.S. Pat. No. 4,027,188 (Bergman) discloses a tubular plasma display consisting of parallel glass capillary tubes sealed in a plenum and attached to a rigid substrate. U.S. Pat. No. 5,984,747 (Bhagavatula et al.) discloses rib structures for containing plasma in electronic displays that are formed by drawing glass preforms into fiber-like rib components. The rib components are then assembled to form rib/channel structures suitable for flat panel displays. U.S. Patent Application Publication 2001/0028216A1 (Tokai et al.) discloses a group of elongated illuminators in a gas discharge device. U.S. Pat. No. 6,255,777 (Kim et al.) and U.S. Patent Application Publication 2002/0017863 (Kim et al.) of Plasmion disclose a capillary electrode discharge PDP device and a method of fabrication.

The following U.S. patents by Fujitsu Ltd. of Kawasaki, Japan disclose PDP structures with elongated display tubes and are incorporated herein by reference. U.S. Pat. Nos. 6,914,382 (Ishimoto et al.), 6,893,677 (Yamada et al.), 6,857,923 (Yamada et al.), 6,841,929 (Ishimoto et al.), 6,836,064 (Yamada et al.), 6,836,063 (Ishimoto et al.), 6,794,812 (Yamada et al.), 6,677,704 (Ishimoto et al.), 6,650,055 (Ishimoto et al.), 6,633,117 (Shinoda et al.), 6,930,442 (Awamoto et al.), 6,932,664 (Yamada et al.), 6,969,292 (Tokai et al.), 7,049,748 (Tokai et al.), and 7,083,681 (Yamada et al.).

U.S. Patent Application Publications Nos. 2004/0033319 (Yamada et al.) and 2003/0182967 (Tokai et al.) by Fujitsu Ltd. of Kawasaki, Japan disclose PDP structures with elongated display tubes and are incorporated herein by reference.

As used herein elongated tube is intended to include capillary, filament, filamentary, illuminator, hollow rods, or other such terms. It includes an elongated enclosed gas filled structure having a length dimension that is greater than its cross-sectional width dimension. The width of the tube is typically the viewing direction of the display. Also as used herein, an elongated plasma-tube has multiple gas discharge pixels of 100 or more, typically 500 to 1000 or more, whereas a plasma-shell typically has only one gas discharge pixel. In some special embodiments, the plasma-shell may have more than one pixel, i.e., 2, 3, or 4 pixels up to 10 pixels.

PDP with Light-emitting Elements

The U.S. patents issued to George et al. and his joint inventors listed below disclose light-emitting elements and are incorporated herein by reference. These include tubes and microspheres. U.S. Pat. Nos. 6,545,422 (George et al.), 6,570,335 (George et al.), 6,612,889 (Green et al.), 6,620,012 (Johnson et al.), 6,646,388 (George et al.), 6,762,566 (George et al.), 6,764,367 (Green et al.), 6,791,264 (Green et al.), 6,796,867 (George et al.), 6,801,001 (Drobot et al.), 6,822,626 (George et al.), 6,902,456 (George et al.), 6,935,913 (Wyeth et al.), 6,975,068 (Green et al.), 7,005,793 (George et al.), 7,025,648 (Green et al.), 7,125,305 (Green et al.), 7,137,857 (George et al.), 7,140,941 (Green et al.), U.S. Patent Application Publication Nos. 2004/0063373 (Johnson et al.), 2005/0095944 (George et al.), and 2006/0097620 (George et al.).

Positive Column Gas Discharge

In one embodiment of this invention, it is contemplated that the PDP may be operated using positive column gas discharge. The use of plasma-tubes and/or plasma-shells, including plasma-spheres, plasma-discs, and plasma-domes allow the PDP to be operated with positive column gas discharge, for example as disclosed by Weber, Rutherford, and other prior art cited hereinafter and incorporated by reference. The discharge length inside the plasma-shell must be sufficient to accommodate the length of the positive column gas discharge, generally up to about 1400 micrometers. Plasma-disc or plasma-dome may comprise flattened or partially flattened microspheres. In some embodiments, elongated tubes called plasma-tubes may be used. The flattened tubes may be of any geometric shape and of any predetermined length, typically up to about 1400 micrometers to accommodate positive column discharge. A plasma-tube differs from a plasma-shell by containing multiple gas discharge cells or pixels, i.e. 100 or more pixels. The following prior art references relate to positive column discharge and are incorporated herein by reference.

U.S. Pat. No. 6,184,848 (Weber) discloses the generation of a "positive column" plasma discharge wherein the plasma discharge evidences a balance of positively charged ions and electrons. The PDP discharge operates using the same fundamental principle as a fluorescent lamp, i.e., a PDP employs ultraviolet light generated by a gas discharge to excite visible light-emitting phosphors. Weber discloses an inactive isolation bar.

Rutherford, James. "PDP With Improved Drive Performance at Reduced Cost." *Proceedings of the Ninth International Display Workshops*, Hiroshima, Japan (Dec. 4-6, 2002): 837-840 discloses an electrode structure and electronics for a "positive column" plasma display. Rutherford discloses the use of the isolation bar as an active electrode.

Additional positive column gas discharge prior art incorporated by reference include:

Weber, Larry F. "Positive Column AC Plasma Display." 23rd *International Display Research Conference Proceedings*, Phoenix, Ariz. IDRC 03, (Sep. 16-18, 2003): 119-124

Nagorny et al. "Dielectric Properties and Efficiency of Positive Column AC PDP." 23rd *International Display Research Conference*, IDRC 03, Phoenix, Ariz. (Sep. 16-18, 2003) P-45: 300-303

Drallos et al. "Simulations of AC PDP Positive Column and Cathode Fall Efficiencies." 23rd *International Display Research Conference Proceedings*, IDRC 03, Phoenix, Ariz. (Sep. 16-18, 2003) P-48: 304-306

U.S. Pat. No. 6,376,995 (Kato et al.)

U.S. Pat. No. 6,528,952 (Kato et al.)

U.S. Pat. No. 6,693,389 (Marcotte et al.)

U.S. Pat. No. 6,768,478 (Wani et al.)

U.S. Patent Application Publication 2003/0102812 (Marcotte et al.)

U.S. Pat. No. 7,122,961 (Wedding)

U.S. Pat. No. 7,157,854 (Wedding)

U.S. Pat. No. 7,176,628 (Wedding)

PDP Priming and Conditioning

It is known in the prior art that the ionizable gas in a gas discharge plasma display must be primed or conditioned in order to obtain a gas discharge. This priming or conditioning has been defined in the prior art as providing a source of free electrons or photon fluxing for initiation of the discharge.

In DC gas discharge plasma displays, auxiliary energizing cells have been provided for conditioning as disclosed in U.S. Reissue Pat. 28,683 (Kupsky) and U.S. Pat. No. 3,654,507 (Caras et al.). In AC gas discharge plasma, conditioning has been done by the use of pilot electrodes or a radioactive material as disclosed in U.S. Pat. 3,928,781 (Edwards et al.). Pilot lights are also disclosed in U.S. Pat. 3,609,658 (Soltan).

These pilot lights have also been called "keep-alive" cells as disclosed in U.S. Pat. Nos. 3,979,638 (Ngo) and 4,009,415 (Ngo).

Wide border conditioning electrodes have been used as disclosed in U.S. Pat. 3,878,420 (Fein et al.).

In U.S. Pat. 3,982,155 (Fein), the sustaining voltage to the pilot cells is greater in amplitude than the sustaining voltage applied to the other display cells (or pixels) so as to provide a conditioning photon flux.

High amplitude sustainer pulses have also been applied to conditioning cells or pixels as disclosed in U.S. Pat. Nos. 3,833,831 (Petty et al.) and 3,843,905 (Leuck et al.).

Other conditioning prior art include:

IBM technical Disclosure Bulletin, Vol. 15, No. 8, January 1973, pages 2514, 2515.

IBM technical Disclosure Bulletin, Vol. 20, No. 3, August 1977, pages 1063 to 1068.

SUMMARY OF INVENTION

The invention relates to the priming or conditioning of an AC gas discharge plasma display panel for improved selective write and selective erase which comprises scanning or addressing n number of rows (row electrodes) in an order or sequence that is changed from frame to frame such that later rows to be scanned are advanced in the sequence with each subsequent scan. As used herein, scanning means addressing.

This invention relates to an AC plasma display device comprising an AC gas discharge plasma display panel (PDP) and electronic means to apply voltage potential at selected cell sites. As used herein the term cell also means pixel. In a monochrome (single color) plasma display, each gas discharge (plasma) site is called a cell, pixel, or pd. In a multicolor plasma display, two or more discharge sites (each exiting a different phosphor) form a cell, pixel or pd. Each of the multiple discharge sites may also be called a cell, pixel, pel, sub-cell, sub-pixel or sub-pd. As used herein, the term cell means any of the above including pixel, pel, sub-cell, sub-pixel, or sub-cell.

Cell sites are formed by the configuration of the electrodes. In DC PDP there are opposing orthogonal arrays of parallel electrodes, one array consisting of data electrodes and the opposing array consisting of scan electrodes, the crossover or intersection of a data electrode and an opposing orthogonal scan electrode forming a cell site. These electrodes are in direct contact with an ionizable gas. When a voltage potential is applied to a single pair of data and scan electrodes, the ionizable gas is excited and produces a gas discharge. The gas discharge may emit light in the visible region or emit UV light that excites a phosphor so as to cause the phosphor to emit light.

An AC PDP differs from a DC PDP in that at least one electrode at the cell site in a AC PDP is covered by a dielectric material and is not in direct contact with the ionizable gas. The PDP industry typically uses an AC PDP with a surface discharge structure, for example, as disclosed by U.S. Pat. Nos. 5,661,500 (Shinoda et al.) and 5,674,553 (Shinoda et al.), cited above and incorporated herein by reference, for a color AC gas discharge (plasma) display. In the referenced Shinoda patents, two parallel electrodes on a front substrate act to produce a sustain voltage and an orthogonal column data electrode on the rear substrate provides the write and erase voltage pulses.

In one embodiment of this invention, there is used a surface discharge AC PDP structure. In other embodiments of this invention, there is used a surface discharge AC PDP constructed of a multiplicity of microspheres and/or elongated tubes of any suitable geometric cross-section or volumetric configuration including flattened or partially flattened bodies such as discs and domes. The AC PDP may comprise dual (opposing) substrates or may be on a single (monolithic) substrate.

As used herein, an elongated tube is referred to as a plasma-tube and a microsphere is referred to as a plasma-shell. One or more plasma-tubes and/or plasma-shells is located on a substrate and electrically connected to at least two electrical conductors such as electrodes. The plasma-tube and/or plasma-shell may be located on the surface of the substrate or within the substrate. In accordance with one embodiment of this invention, insulating barriers are provided to prevent contact between the connecting electrodes. The plasma-tube may be of any suitable cross-sectional shape. The plasma-shell may be of any suitable geometric shape such as a plasma-sphere, plasma-disc, or plasma-dome for use in a gas discharge plasma display panel (PDP) device. This invention also includes the use of elongated tubes alone or in combination with plasma-shells. As used herein, the locating or placing of the plasma-tube and/or plasma-shell on the substrate and/or electrodes includes positioning, attaching, mounting, or like contact.

A plasma-sphere is a hollow microsphere or sphere with relatively uniform shell thickness. A PDP microsphere is disclosed in U.S. Pat. No. 6,864,631 (Wedding), incorporated herein by reference. The shell is typically composed of a dielectric material and is filled with an ionizable gas at a desired mixture and pressure. The gas is selected to produce visible, ultraviolet (UV), and/or infrared (IR) photons during gas discharge when a voltage is applied. The shell material is selected to optimize dielectric properties and optical transmissivity. Additional beneficial materials may be added to the inner or outer surface of the sphere shell including luminescent and/or secondary electron emission materials. Luminescent substances and secondary electron emission materials may be added to the shell. The luminescent substances may comprise any suitable inorganic and/or organic substances that emit photons when excited by photons from the gas discharge. The organic and/or inorganic luminescent substances, secondary electron emission materials, and/or other materials may be added directly to the shell material or composition during or after shell formation.

A plasma-disc is the same as a plasma-sphere in material composition and the ionizable gas selection. It differs from the plasma-sphere in that it is flat on two opposing sides such as the top and bottom. As used herein, a flat side is defined as a side having a flat surface. The other sides or ends of the plasma-disc may be round or flat. The plasma-disc may have other flat sides in addition to the opposing flat sides. The plasma-disc does not have to be round or circular. It may have any geometric shape with opposing flat sides.

A plasma-dome is the same as a plasma-sphere and plasma-disc in material composition and the ionizable gas selection. It differs in that one side is rounded or domed and the opposing side is flat, such as a flat bottom and domed top or vice versa. Other sides of the plasma-dome may be flat or domed. A variety of geometric shapes are contemplated.

DETAILED DESCRIPTION OF THE DRAWINGS

Figure 1:
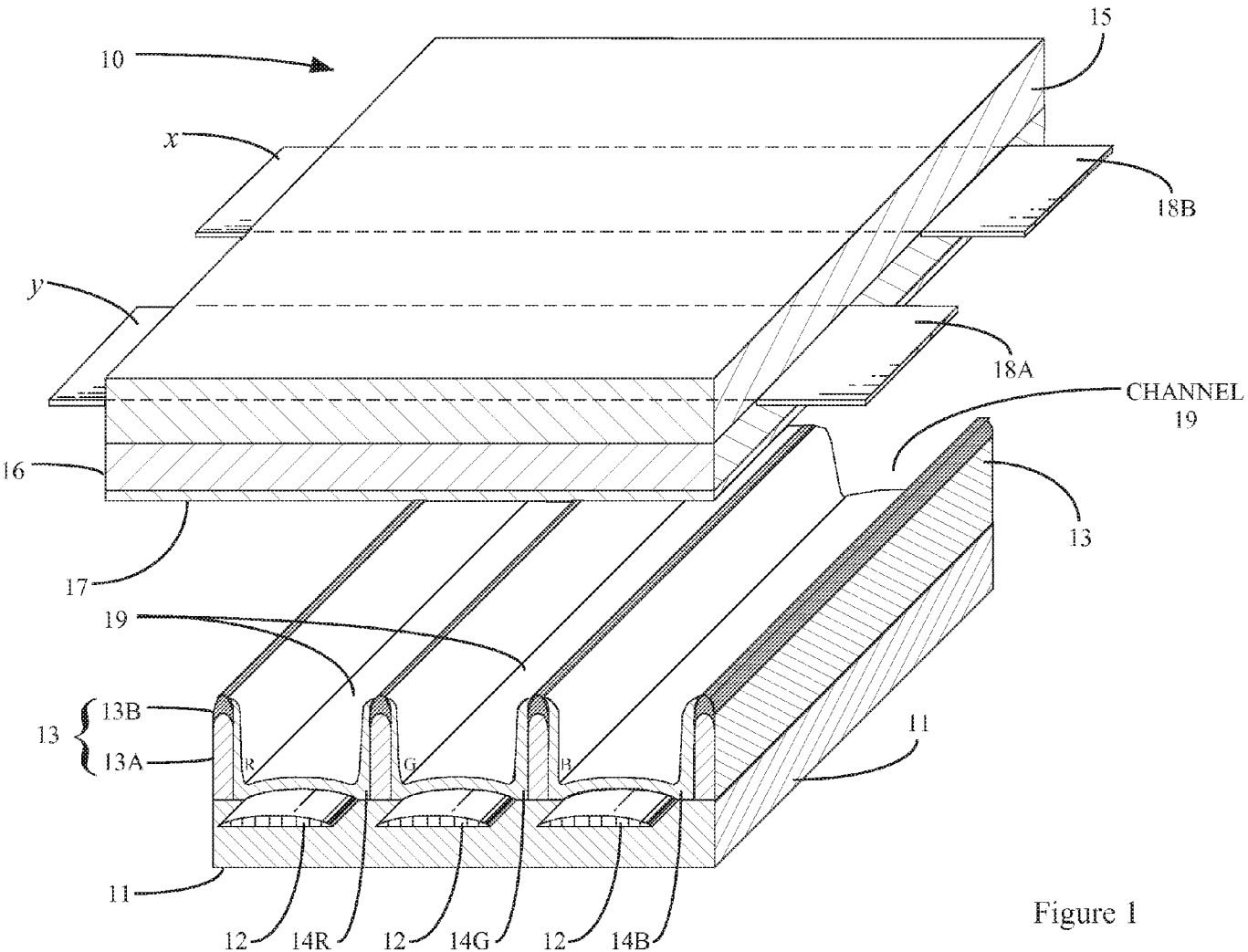
FIG. 1 shows a prospective view of an AC gas discharge (plasma) display panel with dual or opposing substrates.
Figure 2:
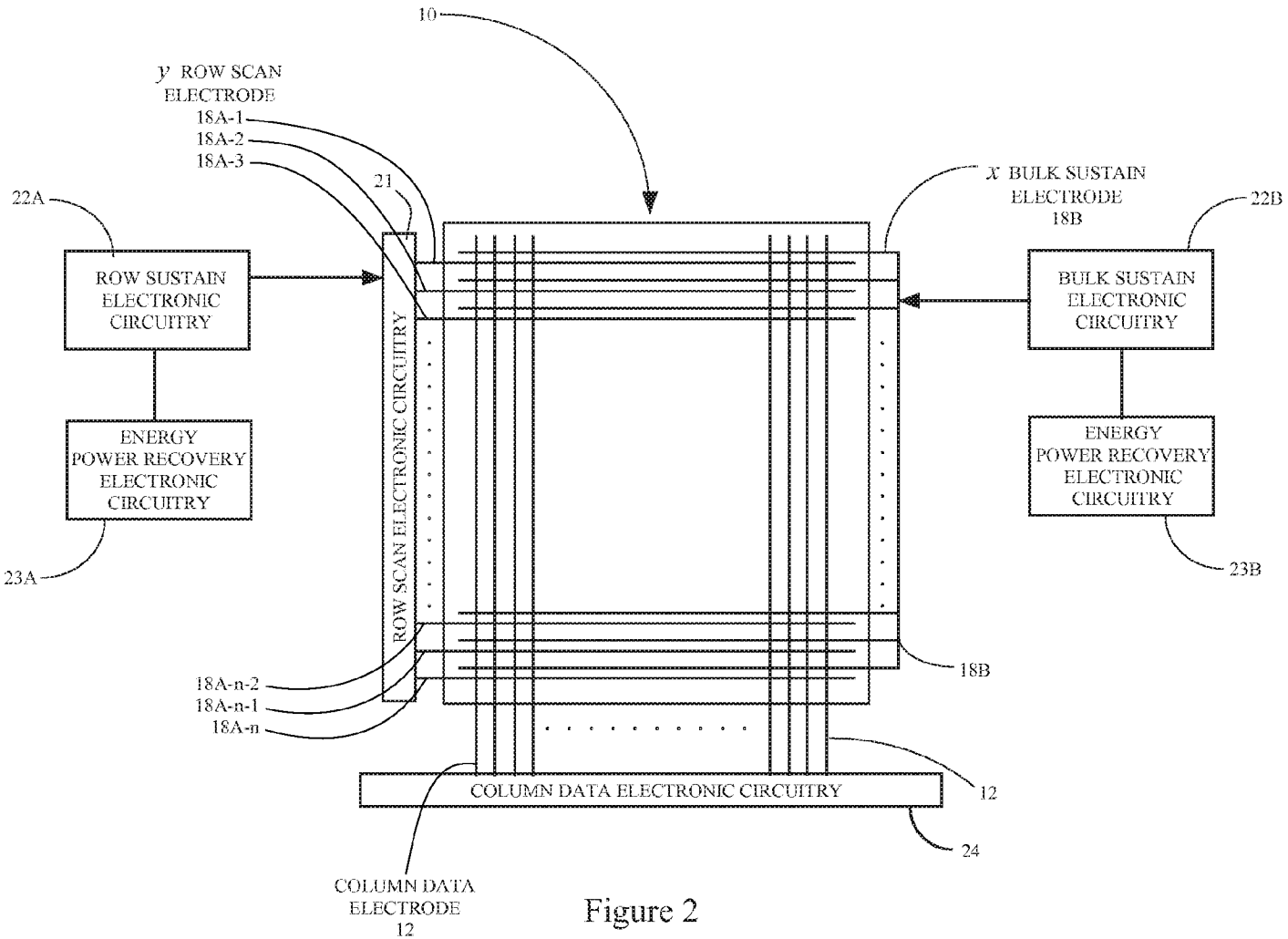
FIG. 2 shows a block diagram of electronics for driving an AC gas discharge plasma display.

FIG. 1 shows a dual substrate surface discharge AC gas discharge plasma display panel structure 10 similar to the structure illustrated and described in FIG. 2 of U.S. Pat. No. 5,661,500 (Shinoda et al.) cited above and incorporated herein by reference. The panel structure 10 has a bottom or rear glass substrate 11 and a top substrate 15.

The bottom substrate 11 contains electrodes 12, barriers 13, and phosphor 14R, 14G, 14B. Each barrier 13 comprises a bottom portion 13A and a top portion 13B. The top portion 13B is dark or black for increased contrast ratio. The bottom portion 13A may be translucent, opaque, dark, or black.

The top substrate 15 is transparent glass for viewing and contains y row scan electrode 18A and x bulk sustain electrode 18B, dielectric layer 16 covering the electrodes 18A and 18B, and a magnesium oxide layer 17 covering the surface of dielectric 16. The magnesium oxide is for secondary ion emission and decreases the overall operating voltage of the display.

A plurality of channels 19 are formed by the barriers 13 and phosphor 14. When the two substrates 11 and 15 are sealed together, an ionizable gas mixture is introduced into the channels 19. This is typically a Penning mixture of the rare gases such as neon, argon, xenon, krypton, and/or helium.

Each electrode 12 on the bottom substrate 11 is called a column data electrode. The y electrode 18A on the top substrate 15 is the row scan electrode and the x electrode 18B on the top substrate 15 is the bulk sustain electrode. The gas discharge is initiated by voltages applied between a bottom column data electrode 12 and a top y row scan electrode 18A. The sustaining of the resulting discharge is done between an electrode pair of the top y row scan electrode 18A and a top x bulk sustain electrode 18B. Each pair of the y and x electrodes is a row.

Phosphor 14R emits red luminance when excited by photons from the gas discharge within the plasma panel. Phosphor 14G emits green luminance when excited by photons from the gas discharge within the plasma panel. Phosphor 14B emits blue luminance when excited by photons for the gas discharge within the plasma panel. The phosphors may be selected from inorganic and/or organic luminescent substances including mixtures of luminescent substances.

The row scan electrode 18A and the bulk sustain electrode 18B may each be a transparent material such as tin oxide or indium tin oxide (ITO) with a thin conductive ribbon or bus bar along one edge. The ribbon may be any conductive material including gold, silver, chrome-copper-chrome, or like material.

The drive system for an AC plasma display includes electronic circuitry for applying write voltage pulses, erase voltage pulses, and sustain voltage pulses in a selectable fashion to one or more pixels or cells. A write pulse at a pixel cite causes the gas to discharge and emit light. An erase pulse causes the plasma to extinguish. A sustain pulse causes a pixel previously written to continue to emit light until subjected to an erase pulse.

A basic electronic architecture for applying voltages to the three electrodes 12, 18A, 18B is disclosed in U.S. Pat. Nos. 5,661,500 (Shinoda et al.), 5,674,553 (Shinoda et al.) and 5,446,344 (Kanazawa), incorporated herein by reference. This basic architecture is widely used in the PDP industry for addressing and sustaining AC gas discharge (plasma) displays and has been labeled by Fujitsu as ADS (Address Display Separately). In addition to ADS, other suitable architectures are known in the art and are available for addressing and sustaining the electrodes 12, 18A, and 18B of FIG. 1.

FIG. 2 shows display panel 10 with electronic circuitry 21 for the y row scan electrodes 18A-1, 18A-2, 18A-3,18A-n, 18A-n−1, 18A-n−2, etc. bulk sustain electronic circuitry 22B for x bulk sustain electrode 18B and column data electronic circuitry 24 for the column data electrodes 12.

There is also shown row sustain electronic circuitry 22A with an energy power recovery electronic circuit 23A. There is also shown energy power recovery electronic circuitry 23B for the bulk sustain electronic circuitry 22B.

The energy recovery architecture and circuits are well known in the prior art. These include U.S. Pat. Nos. 4,772,884 (Weber et al.), 4,866,349 (Weber et al.), 5,081,400 (Weber et al.), 5,438,290 (Tanaka), 5,642,018 (Marcotte), 5,670,974 (Ohba et al.), and 5,739,641 (Nakamura et al.).

Figure 3:
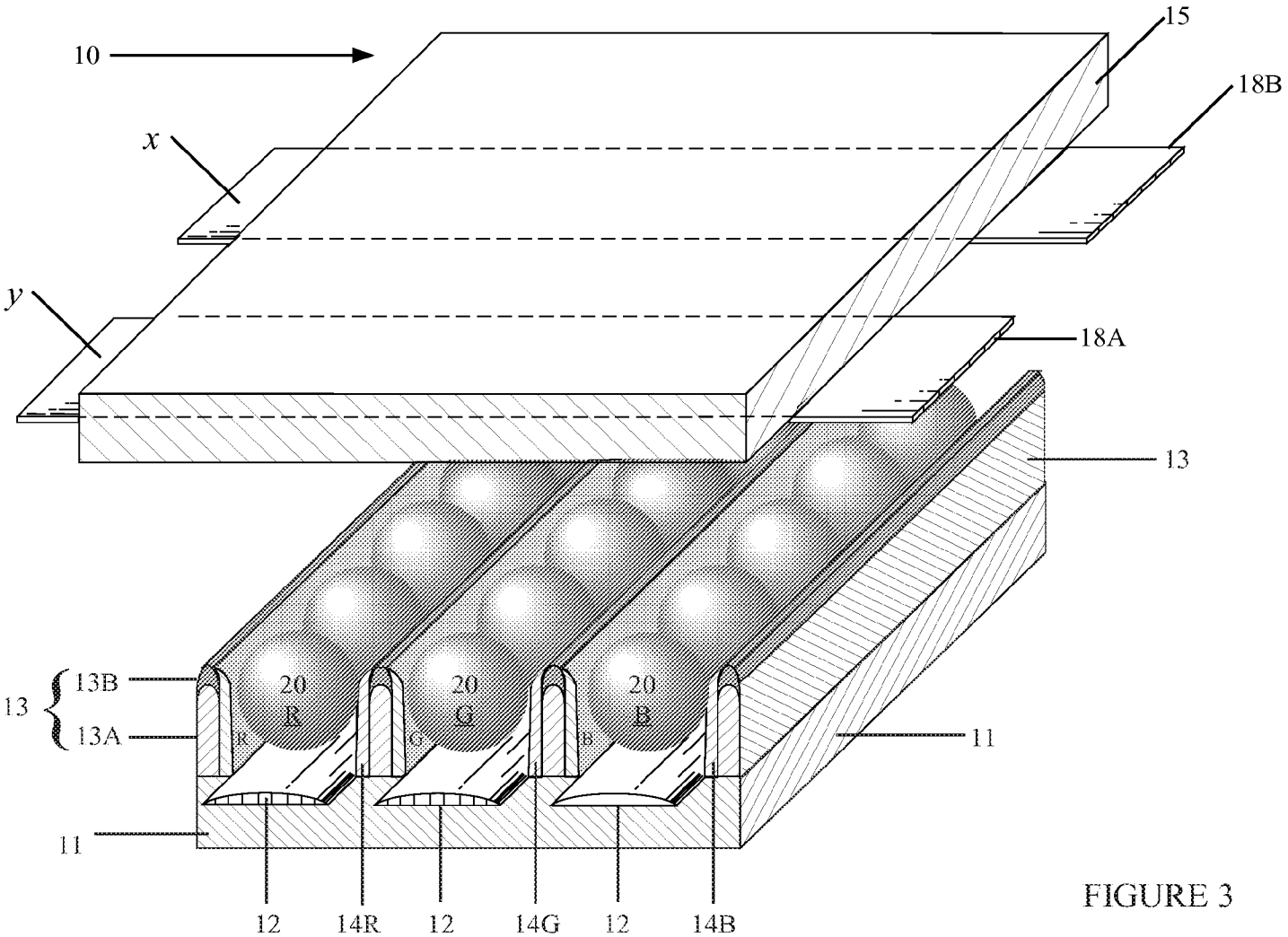
FIG. 3 shows a prospective view of an AC gas discharge (plasma) display panel with dual substrates and gas filled plasma-spheres.

FIG. 3 shows a dual substrate surface discharge (as in FIG. 1) with gas filled plasma-spheres 20R, 20G, and 20B and corresponding phosphor 14R, 14G, and 14B. Other plasma-shells may be used alone or in combination with plasma-spheres.

Figure 4A:
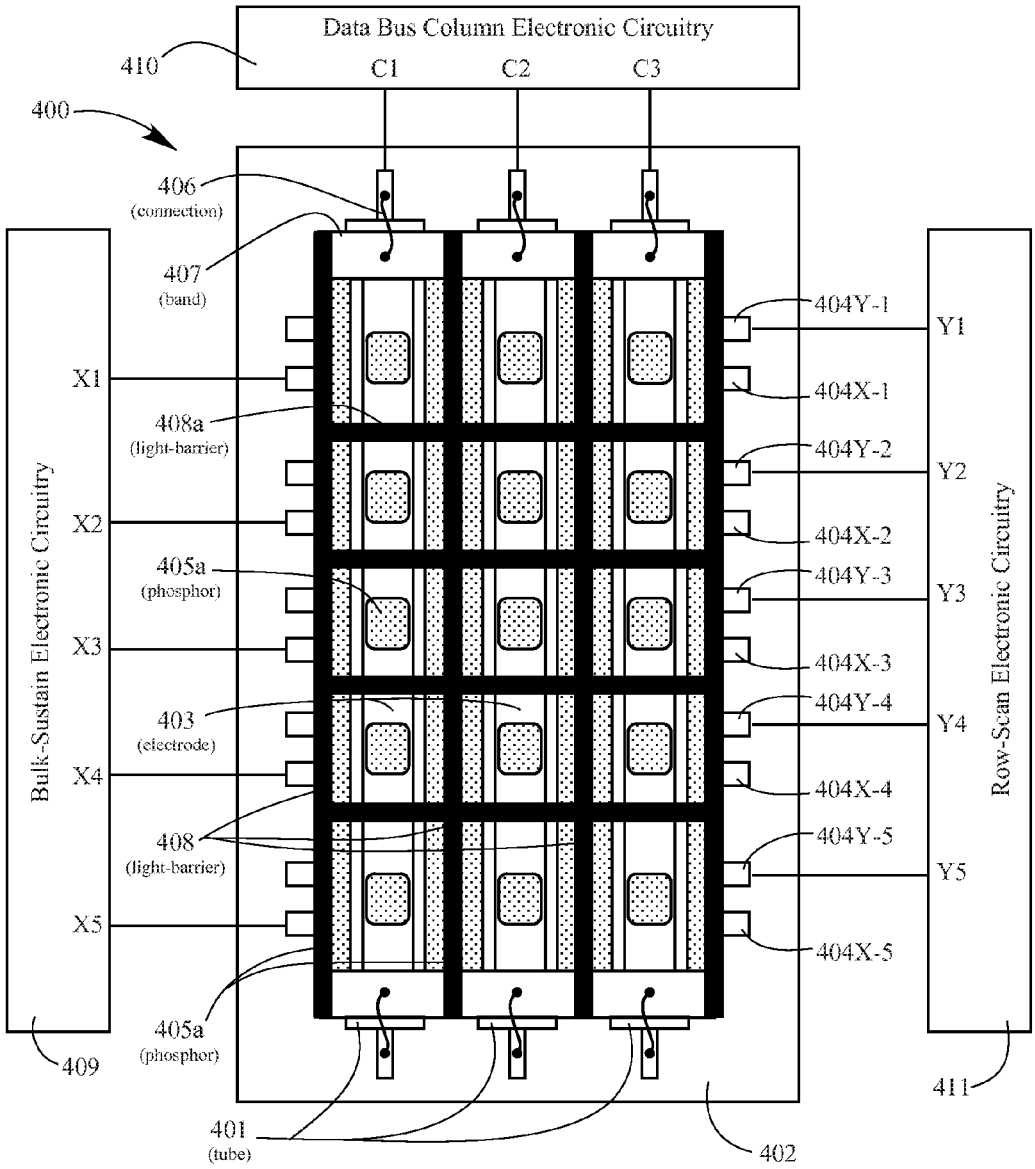
FIG. 4A shows a single substrate AC gas discharge (plasma) display panel with gas filled elongated plasma-tubes and associated electronics.
Figure 4B:
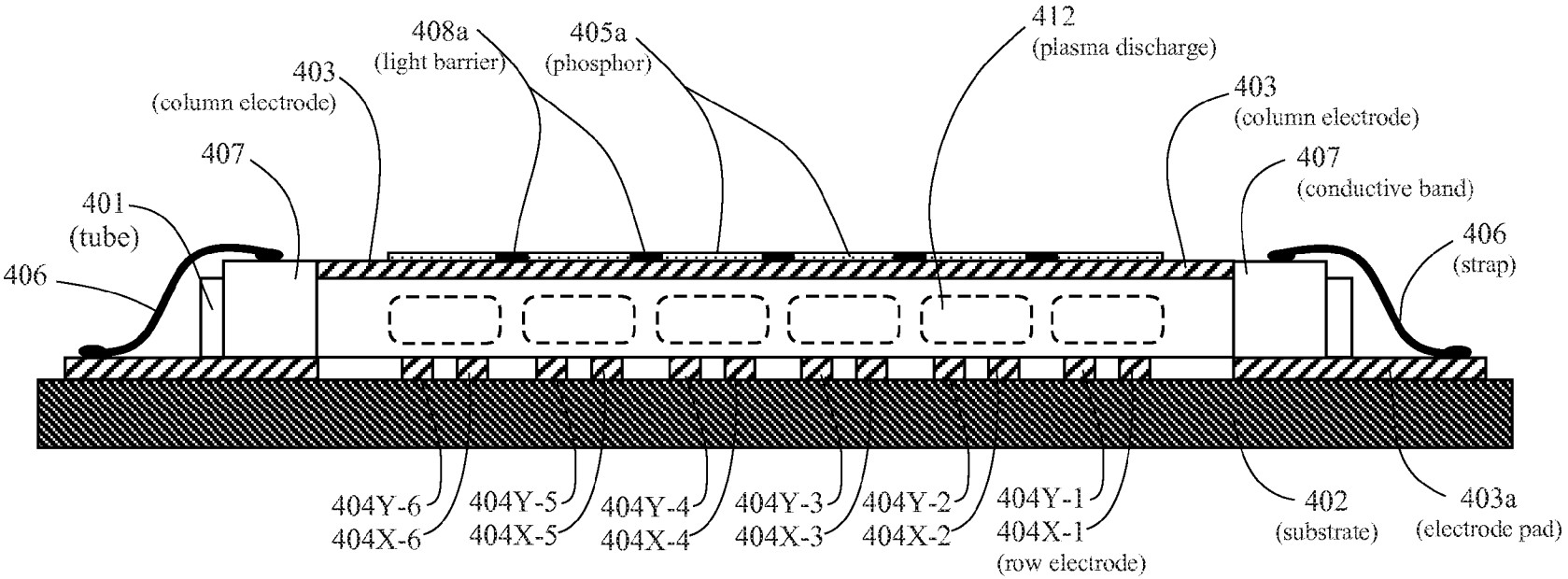
FIG. 4B is a cross sectional view of the substrate and elongated plasma-tubes of FIG. 4A.

FIGS. 4A and 4B show a single substrate surface discharge AC plasma display panel 400 with elongated gas filled plasma-tubes 401 and electronics 409, 410 and 411 arranged for surface discharge. Each column data electrode 403 is connected via conductive band 407 and conductive strap 406 to electrode pad 403*a* which is connected to electronic circuitry 410. The electrodes 404X and 404Y are connected to row scan electronics 411 and sustain electronics 409 such that once a cell discharge is initiated by the data bus electrode 403, the discharge will be sustained between the 404X and 404Y electrodes. FIG. 4B shows the gas plasma discharge 412 directly between electrodes 403 and 404 which provides UV illumination of the surrounding phosphor 405*a* and 405*b*. Also shown are substrate 402, gas filled tube 401, light barriers 408, 408*a*, and multiple gas plasma discharges 412 along the length of tube 401.

Figure 5:
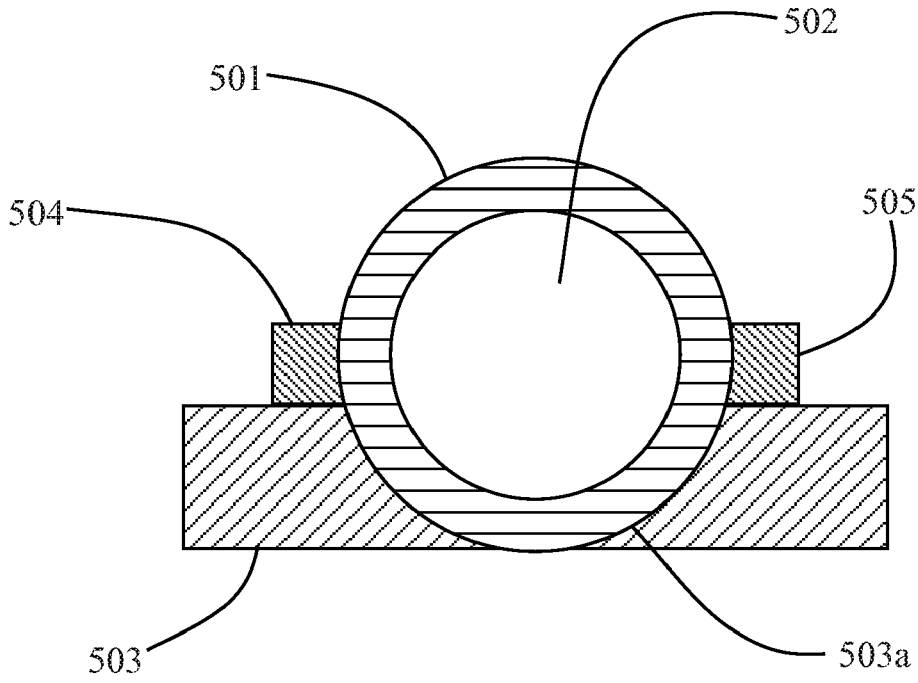
FIG. 5 shows a cross sectional view of a single substrate AC gas discharge (plasma) display panel with a plasma-sphere.

In one embodiment of this invention, a plasma-sphere is used as the pixel or sub-pixel element of a single substrate PDP device as shown in FIG. 5. As shown in FIG. 1, the plasma-sphere 501 is positioned in a well 503*a* on a PDP substrate 503 and is composed of a material selected to have the properties of transmissivity to light, while being sufficiently impermeable as to the confined gas 502. The gas 502 is selected so as to discharge and produce light in the visible or invisible range when a voltage is applied to electrodes 504 and 505. The PDP substrate 503 may be constructed of a rigid or flexible material. It may be opaque, transparent, translucent, or non-light transmitting. In the case where the discharge of the ionizable gas produces photons, a photon excitable inorganic and/or organic luminescent substance such as a photoluminescent phosphor may be applied to the exterior or interior of the plasma-sphere 501 or embedded within the plasma-sphere to produce light. Besides phosphors, other materials may be applied to the interior and exterior of the plasma-sphere to enhance contrast, and/or to decrease operating voltage. One such material contemplated in the practice of this invention is a secondary electron emitter material such as magnesium oxide. Magnesium oxide is used in PDP construction to decrease the PDP operating voltages.

Figure 6:
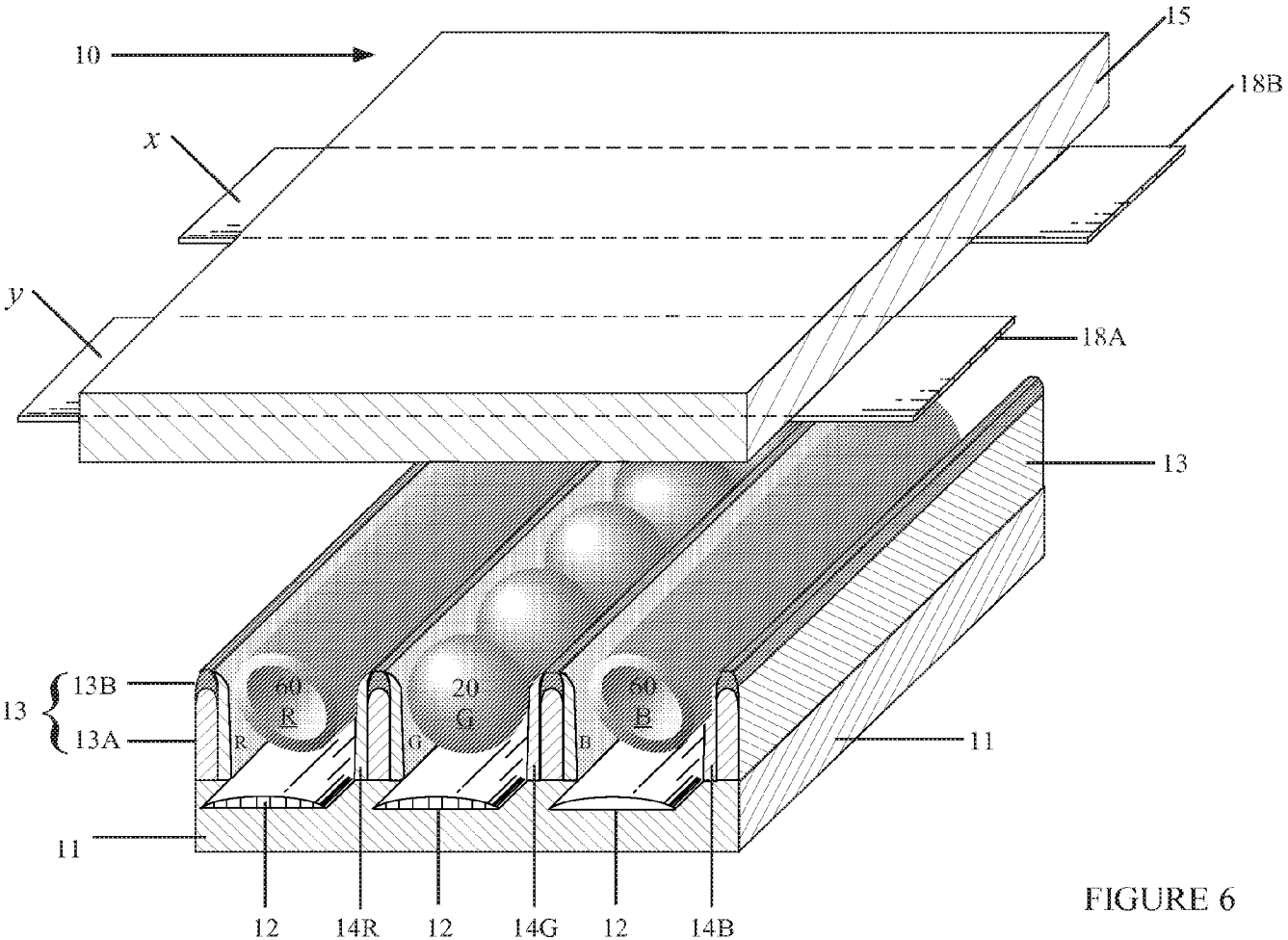
FIG. 6 shows a prospective view of an AC gas discharge (plasma) display panel with dual substrates and both gas filled plasma-spheres and elongated plasma-tubes.

FIG. 6 is the same as FIG. 3 except that elongated plasma-tubes 60R and 60B have replaced plasma-spheres 20R and 20B.

In time multiplexed brightness control, the light output of a given pixel is proportional to the number of sustains in a given cycle that the pixel experiences after it has been written. This time multiplexing is also used to produce pixel-by-pixel gray scale.

Selective write is generally accomplished using the following sequence: (1) A global write is applied to all pixels to prime the ionizable gas. (2) A global erase is applied to all pixels. (3) A selective write is applied to each pixel that is to be written on a row-by-row basis. (4) Global sustains are applied to all pixels and for a time proportional to the desired gray level.

Selective erase is generally accomplished using the following sequence: (1) A global erase is applied to all pixels. (2) A global write is applied to all pixels. (3) A selective write is applied to each pixel that is to be written on a row-by-row basis. (4) Global sustains are applied to all pixels for a time proportional to the desired gray level.

As used herein, addressing includes writing and/or erasing a pixel. Global addressing is the addressing of all pixels in the display and includes global write and/or global erase. In AC gas discharge plasma displays, a problem exists in which pixels in rows that are addressed a short time after a global address has been applied are easier to address with a write or erase voltage pulse, relative to pixels that are addressed a long period of time after the global address is applied. As the same row scan pattern is applied every frame, the result is rows of pixels that are subsequently addressed soon after the global address will continually light or erase with ease whereas rows that are addressed a longer time after the global address pulse are more difficult to write or erase and may not write or erase at all. This problem will manifest itself in rows (row electrodes) of the display with pixels that do not light or erase consistently.

Therefore, in an AC plasma panel with n rows (or row electrodes) and a selective address scheme, the pixels become more and more difficult to address as one addresses rows 1 to n. In FIG. 2, these are shown as row electrodes 18A-1 to 18A-n. As stated above, addressing includes both writing and erasing a pixel. Thus where write or erase voltage pulses are applied to the pixels in row electrode 1 to row electrode n in a PDP with n electrodes, it becomes more difficult to write or erase each succeeding row of pixels. It is also more difficult to write or erase the pixels in row electrode n relative to the pixels in row electrode n−1. Likewise, the pixels in row n−1 are more difficult to write or erase than the pixels in row n−2, and so forth.

The problem is most noticeable in scan or address patterns that go from top to bottom. In this case, it is very noticeable that pixels toward the bottom of the display panel or screen fail to light or erase. To eliminate this problem, many manufacturers scan in an interlace pattern. This helps spread the priming or conditioning of the ionizable gas, but it is still noticeable that certain rows of pixels do not write or erase as well as others.

This invention seeks to eliminate the problems discussed above regarding selective write and selective erase by scanning the rows (row electrodes) in an order or sequence that is changed from frame to frame. A frame consists of the scanning of all of the PDP row electrodes 18A (rows) in any selected sequence. In this invention, the scanning of a frame begins with a new or different row electrode used to start the scan of the preceding frame.

In the practice of this invention where there are n rows of pixels or cells to be addressed, the order of the scanning of the rows is changed sequentially from scan to scan such that the later rows to be scanned are advanced in the sequence with each subsequent scan. More particularly, rows 1 to n are scanned followed by the scanning of row 2 to row n+1 where row n+1 is original row 1, then the scanning of row 3 to row n+2 where row n+2 is original row 2, and so forth. Thus in FIG. 2, row electrodes 18A-1 to 18A-n are addressed. This is one frame. At the start of the next frame, a different row is first addressed, such as 18A-2. Original row 18A-1 becomes 18A-n+1 in the new frame.

The scanning sequence may also be advanced by skipping rows, e.g., by scanning rows 1 to n followed by the scanning of rows 3 to n+2, rows 5 to n+4, and so forth. Rows may be advanced and scanned in any order so long as each frame begins with a row different from the preceding row.

This advancing of the scanning sequence evens out the priming or conditioning of the gas in an AC gas discharge display, especially a surface discharge AC plasma display with ribs, walls, or like barriers separating rows of pixels to be addressed. Such barriers are disclosed in the AC plasma display patents referenced above including U.S. Pat. Nos. 5,661,500 (Shinoda et al.) and 5,674,553 (Shinoda et al.).

These barriers tend to prevent the flow of ionizable gas from one row of pixels to another such that the priming or conditioning of the gaseous medium (and pixels) in one row has little or no effect on the priming or conditioning of the gaseous medium (and pixels) in other rows. This invention provides continuous and uniform priming and conditioning of all pixels in all of the rows.

Figures 7, 8:
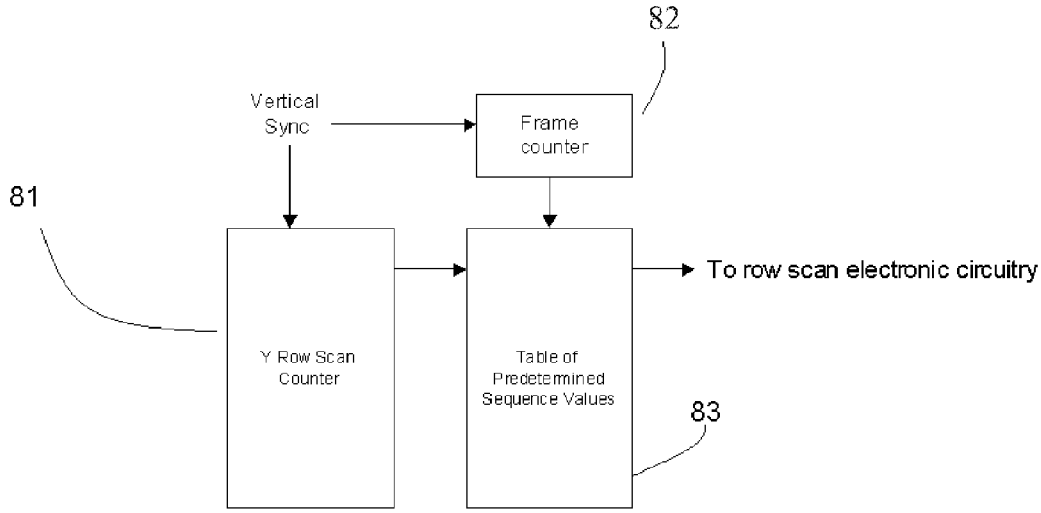
FIG. 7 is a row scanning or addressing sequence for the practice of this invention.
FIG. 8 shows a block diagram for row scan or address sequencing.

FIG. 7 is a row scanning or addressing sequence illustrative of this invention. In this embodiment, y row scan electrodes 18A-1 through 18A-n of FIG. 2 are scanned sequentially in a given frame. In accordance with this invention, the scanning sequence begins with a different y row scan electrode each frame. As shown in this example in Frame 1, scanning begins with y row scan electrode 18A-1 and ends with 18A-n. In the next frame, Frame 2, the scanning sequence begins with the second y row scan electrode, 18A-2, and continues through the sequence to 18A-n, and wraps around to y row scan electrode 18A-1. This wrap around sequence continues until the final y row scan electrode, 18A-n, is addressed first and the first y row scan electrode is addressed second. After this last frame (Frame n) the sequence is repeated. The scanning sequence is predetermined and independent of the image displayed.

Other scanning sequences are contemplated including various interlacing patterns that may provide additional advantages in image enhancement, or power reduction. However, a key feature of this invention is that the addressing pattern is predetermined, and the scanning pattern varies between at least two frames. This is described with reference to plasma displays, but may also be used with other displays particularly flat panel displays such as LCD, OLED, EL, LED, and others. In accordance with this invention, the row address scanning sequence used to address the flat panel display is characterized by a predetermined pattern used in one frame and by a different predetermined pattern in one or more other frames. The predetermined pattern is independent of the displayed image, the current consumption, and the power consumption.

FIG. 8 shows a block diagram for row scan or address sequencing. This can be implemented using a variety of methods known and practiced in the art including programmable logic, micro controllers, discreet logic, various memory devices and/or a combination of these. Y Row Scan Counter 81 counts the Y rows of the PDP. The incrementing of the counter is synchronized with the waveform that drives the display. It is cleared at the end of each frame by a suitable timing signal synchronous with vertical sync. The output of the Y Row Scan Counter 81 is used to access the addresses of the Table of Predetermined Sequence Values 83. Frame Counter 82 counts the frame number. It is incremented by vertical sync or some suitable signal synchronous with vertical sync. It has a maximum count of the number of unique frame sequences. The output of the Frame Counter 82 is also used to access the Table of Predetermined Sequence Values 83.

Figure 9:
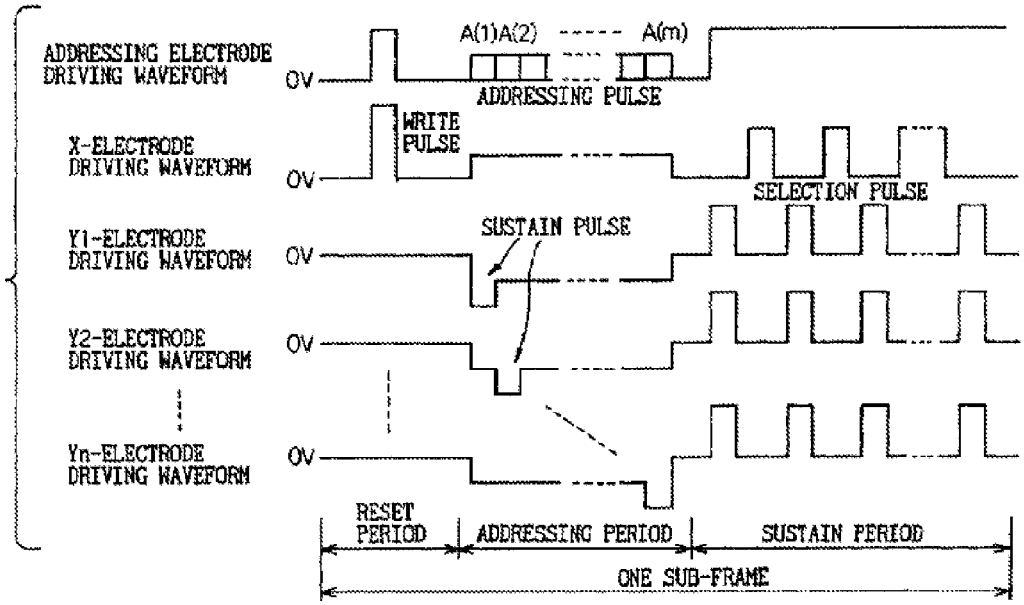
PRIOR ART Figure 9
FIG. 9 shows prior art architecture for addressing and sustaining a PDP.

FIG. 9 shows a prior art architecture for addressing a flat panel display including a PDP. This is identical to FIG. 6 of U.S. Pat. 6,636,187 (Tajima et al.), incorporated herein by reference. The architecture illustrated and discussed in Tajima et al. ('187) may be used with the invention at bar.

FIG. 9 is illustrative of a typical PDP waveform. During the reset period all pixels of the PDP are made to have the same wall charge. During the addressing period, pixels are selectively addressed on a row by row basis. During the addressing period, pixels are selectively set to an "on" state or an "off" state. The "on" state is characterized by the presence of wall charge. The "off" state is characterized by the absence of wall charge. If the addressing period is characterized by selectively writing, (setting select pixels to the "on" state), the reset period must include a erase pulse to turn all pixels to the "off" state. If the addressing period is characterized by selectively erasing, (setting select pixels to the "off" state), the reset period must include a write pulse to turn all pixels to the "on" state. During the sustain period, pixels that have been selectively addressed are exposed to sustaining potentials for a number of cycles to cause the pixels to emit light.

A standard plasma display is addressed one row at a time. The addressing of each row takes a finite amount of time. In order to maintain a flicker free image, the display must be updated at video rates. In order to achieve more rows with a plasma display, often the column electrodes are split at the center of the display and the two halves are addressed from the top and from the bottom as two independent displays. This is referred to in the PDP industry as dual scan. This invention may be practiced with or without dual scan. If dual scan is used, the PDP is more readily split into sections by using plasma-shells, plasma-tubes, and/or a combination of plasma-shells and plasma-tubes. As noted above, these may be of any suitable geometric cross-section or volumetric configuration including flattened or partially flattened bodies such as discs and domes.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. In the operation of an AC gas discharge plasma display having n number of row electrodes to be addressed, and wherein the addressing of all n rows comprises one frame, the improvement which comprises addressing the n number of row electrodes in a sequence that is changed from frame to frame so as to address a different row electrode at the beginning of each frame.

2. The invention of claim 1 wherein the plasma display is a surface discharge display structure.

3. The invention of claim 1 wherein the plasma display is constructed of plasma-shells.

4. The invention of claim 1 wherein the plasma display is constructed of plasma-tubes.

5. The invention of claim 1 wherein the plasma display is constructed of a combination of plasma-shells and plasma-tubes.

6. In an AC gas discharge plasma display having n number of electrode rows to be addressed with write or erase voltages, each frame consisting of the addressing of all n rows, the improvement which comprises addressing the n number of rows in a sequence that is changed from frame to frame such that later rows to be addressed are advanced in the sequence with each subsequent scan of the next frame.

7. The invention of claim 6 wherein the plasma display is constructed of plasma-shells.

8. The invention of claim 6 wherein the plasma display is constructed of plasma-tubes.

9. The invention of claim 6 wherein the plasma display is constructed of a combination of plasma-shells and plasma-tubes.

10. A method for addressing an AC gas discharge plasma display panel with n number of rows of pixels wherein the addressing of all n rows comprises one frame, which comprises addressing the n number of rows in a sequence that is changed from frame to frame at the beginning of each frame so as to uniformly and continuously prime the pixels of each scanned row.

11. In a method of addressing a gas discharge plasma display comprising a matrix of multiple gas discharge pixels arranged in n number of rows, each pixel being confined within a plasma-shell, and wherein the addressing of all n rows comprises one frame, the improvement which comprises priming said pixels by addressing said n rows of pixels in a timing sequence that is changed from frame to frame so as to address a different row of pixels at the beginning of each frame.

12. The invention of claim 11 wherein the row addressing sequence is characterized by a predetermined pattern in one frame and by a different predetermined pattern in one or more subsequent frames.

13. The invention of claim 12 wherein each predetermined pattern is independent of any image on the display.

14. The invention of claim 12 wherein each predetermined pattern is independent of current usage or power consumption.

15. The invention of claim 11 wherein the pixels are within one or more plasma-tubes.

16. The invention of claim 11 wherein each pixel is within a plasma-shell.

* * * * *